United States Patent [19]

Goldfarb et al.

[11] Patent Number: 4,522,606

[45] Date of Patent: Jun. 11, 1985

[54] SELF-POWERED MINIATURE TOY VEHICLE WITH TREADS AND WITH UNUSUAL FOUR-WHEEL-DRIVE CLIMBING CAPABILITY

[75] Inventors: Adolph E. Goldfarb, Westlake Village, Calif.; Delmar K. Everitt, 4310 Tosca Rd., Woodland Hills, Calif. 91356; Norman J. Burger, 10164 Leu Ave., Pacoima, Calif. 91331

[73] Assignees: Delmar K. Everitt, Woodland Hills; Norman J. Burger, Pacoima, both of Calif.

[21] Appl. No.: 463,986

[22] Filed: Feb. 4, 1983

Related U.S. Application Data

[63] Continuation-in-part of Ser. No. 438,510, Nov. 2, 1982, , and Ser. No. 417,554, Sep. 13, 1982, , which is a continuation-in-part of Ser. No. 233,495, Feb. 11, 1981, abandoned, which is a continuation-in-part of Ser. No. 121,645, Feb. 14, 1980, Pat. No. 4,306,375.

[51] Int. Cl.[3] ..... A63H 17/14

[52] U.S. Cl. ..... 446/433; 446/463

[58] Field of Search ..... 446/433, 443, 454, 456, 446/457, 462, 463, 464

[56] References Cited

U.S. PATENT DOCUMENTS

| | | | |
|---|---|---|---|
| 1,754,307 | 4/1930 | Conboy | 46/219 |
| 3,540,152 | 11/1970 | Beny et al. | 46/206 |
| 3,553,886 | 1/1971 | Hamilton | 46/210 |
| 3,735,527 | 5/1973 | Lombardo | 446/457 |
| 3,810,515 | 5/1974 | Ingro | 46/251 X |
| 3,849,931 | 11/1974 | Gulley, Jr. | 446/460 |
| 4,152,866 | 5/1979 | Suda | 46/251 |

*Primary Examiner*—Mickey Yu

*Attorney, Agent, or Firm*—Romney Golant Martin & Ashen

[57] ABSTRACT

This toy operates on continuous-belt treads that cooperate with other "climbing toy" features to provide extremely exaggerated ability to negotiate steep and/or rough surfaces. The car selectably operates: (1) as a conventional electrically powered toy, at at least one speed, on a flat surface; (2) as an electrically powered "climbing toy" with particularly advantageous weight distribution, at at least one reduced speed with greater torque, on a steep and/or irregular surface; or (3) as an unpowered free-rolling toy vehicle. Major weight components, particularly the battery and motor, are in a symmetrical, compact, balanced and relatively low arrangement—at about the same height as the tread drivers. Together with a speed-reduction mechanism they fill the toy's housing. The speed-reduction mechanism preferably has front-and-rear duplicate gear trains: at each end, two worms that are both powered from the motor shaft but through different speed-reduction gears, and an axle-driving worm gear shiftable between the worms.

16 Claims, 16 Drawing Figures

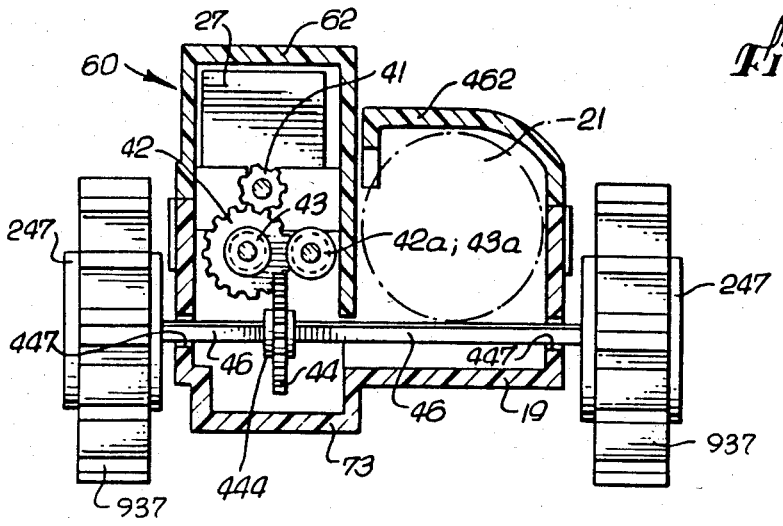
Fig. 5
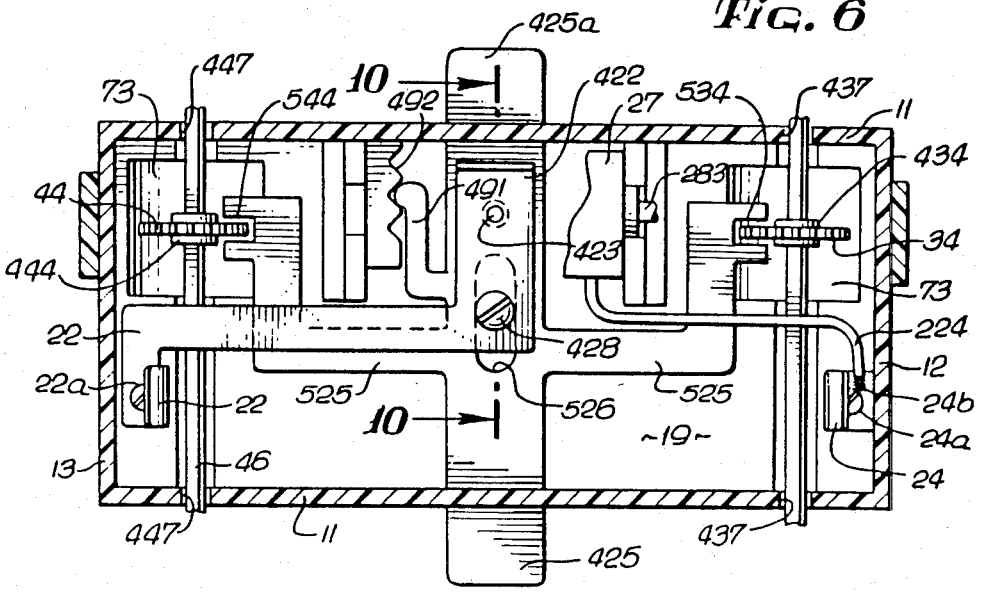
Fig. 6
Fig. 7
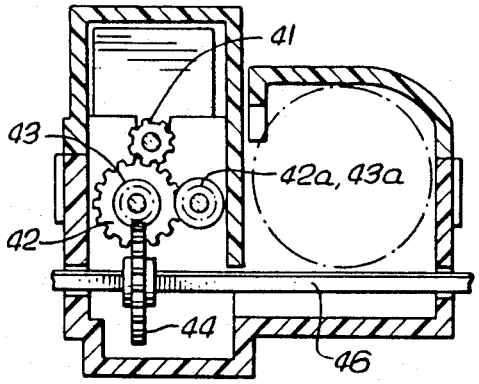
Fig. 8
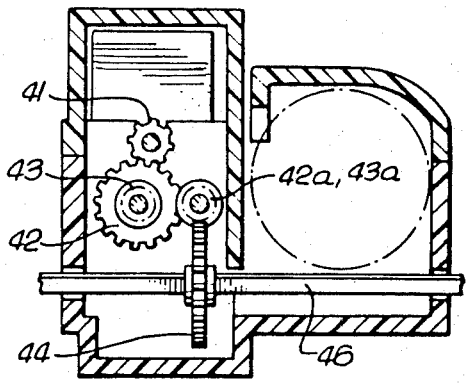

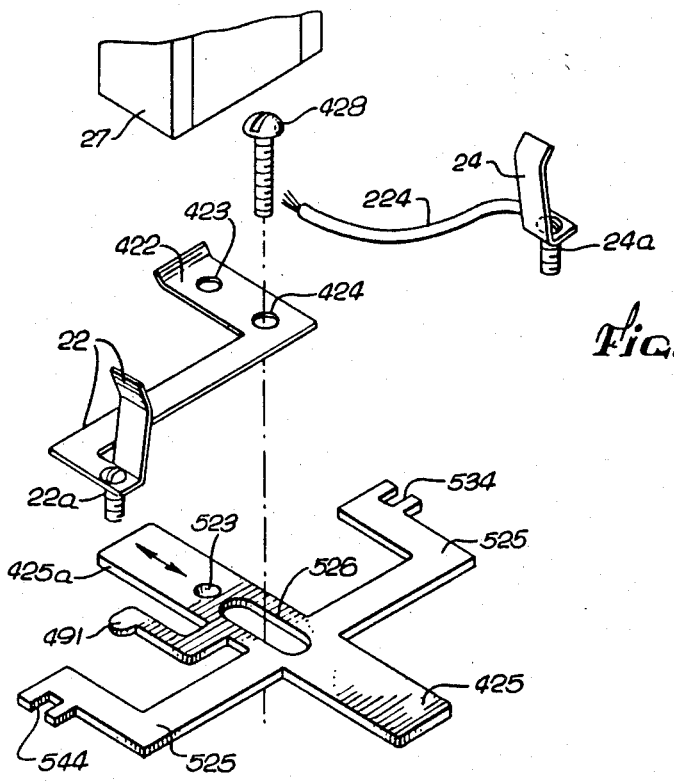
FIG. 9
FIG. 10
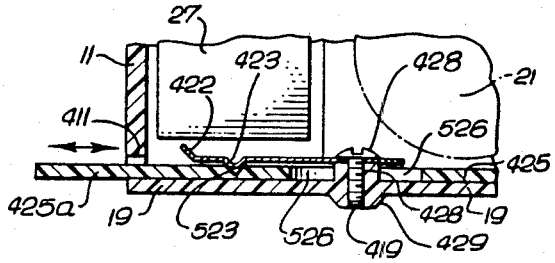
FIG. 11
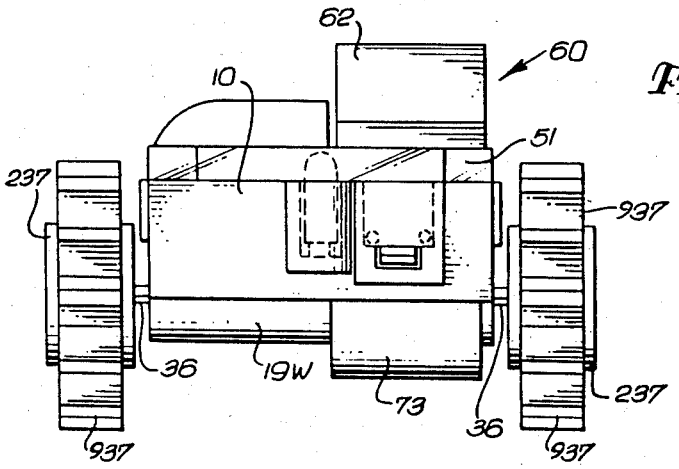

SELF-POWERED MINIATURE TOY VEHICLE WITH TREADS AND WITH UNUSUAL FOUR-WHEEL-DRIVE CLIMBING CAPABILITY

RELATED APPLICATIONS

This application is a continuation-in-part of pending U.S. patent application Ser. No. 438,510, filed Nov. 2, 1982, and U.S. patent application Ser. No. 417,554 filed Sept. 13, 1982. Ser. No. 417,554 itself was a continuation-in-part of then-pending U.S. patent application Ser. No. 233,495, filed Feb. 11, 1981, and now abandoned. The latter application was in turn a continuation-in-part of U.S. patent application Ser. No. 121,645, filed Feb. 14, 1980, and issued Dec. 22, 1981, as U.S. Pat. No. 4,306,375.

BACKGROUND

1. Field of the Invention

This invention relates generally to toy vehicles, and particularly relates to toy vehicles having treads, and to toy vehicles which may be operated in plural alternative modes depending upon the type of operating surface and upon the preference of the user.

2. Other Toy Vehicles

Other tread-driven toys, even those (if any) operating at selectable plural speeds, have in essence provided only a single mode of operation. We are unaware of any tread-driven toy having the "climbing-toy" characteristics that are defined in this document.

For example, the U.S. Pat. No. 4,306,375 mentioned above describes a toy vehicle which has startling climbing characteristics. It is able (traction permitting) to climb any grade on which it will not tip over backward—grades up to about 40°—and to negotiate a vertical step taller than its tire radius. Its chassis is only slightly longer than, and less than twice as wide as, a "penlight" battery.

That toy, however, does not use tread drive. Moreover, that toy, by virtue of its relatively low operating speed, is particularly intended for use in its very unusual operating mode as a special-purpose climbing toy. The phrase "climbing toy" as used in this document means a toy, such as is described in the aforementioned patent, which has extraordinary climbing characteristics and certain features that are aimed at enhancing and maximizing those characteristics.

On the other hand, some earlier toys may have had two or more speeds, but to the best of our knowledge there have been no toys in which such plural speeds were provided for corresponding plural and essentially different operating purposes. As far as we know, prior miniature toy vehicles (other than the "climbing toy" described in the aforementioned patent) have been intended for and capable of self-propulsion across a generally level surface such as the floor or rug in a home, and at relatively low torques and high speeds. For purposes of verbal shorthand in this document we refer to such toys as "generally conventional toys," and to their operation as "generally conventional-toy operation."

Further, we know of no plural-speed powered toys whose speeds can be selected without picking up the entire toy vehicle to manipulate a selector of some kind underneath or inside the vehicle, and/or without using both hands to manipulate the selector. This limitation interferes with the free sway of illusion and fantasy in the use of a powered toy vehicle, by providing an obstacle to a toy user's native imagination. A "real" vehicle would not be raised from the street by its operator for speed changes, and a "real" vehicle is shifted using just one hand, so the illusion of playing with a "real" vehicle is dampened by the necessity to pick up the toy vehicle and to use both hands when changing speeds.

Yet another type of earlier toy, which undoubtedly antedates by centuries those toys just discussed, is the free-rolling vehicle which the user pushes, or allows to roll downhill. Ironically, such a primitive and simple use is not within the capabilities of many modern powered toys, because the motors and particularly the gear trains in many such toys are always engaged with the wheels. In the case of relatively large gear reductions, it can be very difficult to turn the wheels of such a vehicle: the gear train intrinsically resists being operated from its low-mechanical-advantage end.

In the toy vehicle of the earlier-mentioned patent, for instance, an extremely large mechanical-advantage value is obtained by use of a worm and worm gear. As is commonly known, the pitch of a worm is so shallow that it is quite impossible to rotate the worm by turning the worm gear: the worm gear simply binds against what is, in all practical effect, a stop. This effect is somewhat extreme in the toy vehicle of the earlier-mentioned patent, because of the use of a worm and worm gear, but it remains true that many or most powered toys cannot be freely rolled.

Again, we know of no powered toys whose wheels can be disengaged from their gear trains, to permit free rolling use, without picking the toy vehicle up and/or without using both hands to manipulate a selector. This too is an interference with the effectiveness of illusion in the use of a powered toy vehicle, as already described with respect to speed changes.

SUMMARY OF THE DISCLOSURE

A primary objective of our invention is to provide a "climbing toy" in which the "climbing toy" characteristics are enhanced to an extreme and unique degree by their interaction and cooperation with the tread drive.

Another primary objective is to permit a user to convert a tread-driven toy between free-rolling use and powered use—and, in fact, between generally conventional-toy operation and climbing-toy operation as well—with just one hand and without picking up the vehicle.

We believe that this three-mode operation of a single toy, available to the user without the necessity of lifting the toy vehicle from the surface on which it rests or operates, and without the necessity of using both hands, is an entirely new result.

This invention provides a climbing-toy vehicle that is tread driven. In addition, this tread-driven vehicle advantageously is adapted for (1) generally conventional-toy operation at at least one speed on a generally flat surface, (2) climbing-toy operation at at least one reduced speed with greater torque on a steep and/or irregular surface, and (3) free-rolling unpowered miniature "hand toy" vehicle use—all depending upon the setting of a single one-hand-operable control that is accessible to a user without the user's picking the vehicle up.

More specifically, a preferred embodiment of our invention provides a treaded plural-speed miniature toy vehicle that is intended for use with "electrical battery means". Such means include an elongated dry-cell battery preferably of the penlight type—that is to say, a quite small one having a pronounced longitudinal axis—as well as necessary cladding, and such other features as may come to be associated with such batteries. "Electrical battery means" also include more than one battery in a single vehicle.

To obtain the climbing-toy features of our prior invention, the preferred embodiment of our invention advantageously has, when the battery means are in use, major weight components positioned to provide a generally symmetrical, compact, balanced and relatively low arrangement—particularly when considered in relation to wheeled vehicles that have exaggerated ground clearance between the front and rear wheels.

A preferred embodiment of our toy-vehicle invention has a chassis, preferably with walls that define an interior compartment.

It also advantageously has "rotary driving means"—which may include wheel-like structures over which bulldozer-style, half-track-style, or tank-style endless belts may be looped to propel the vehicle. The rotary drive means are mounted to the chassis for rolling rotation about laterally extending axes. Certain embodiments of our invention have both "front rotary driving means" and "rear rotary driving means" whose rotation axes are respective mutually parallel but spaced-apart front and rear axes. The distance between the front and rear axes is generally about two inches in one preferred embodiment of our invention.

Mounted in the interior compartment are means to releasably support the electrical battery means in the compartment. The longitudinal axis of the battery means when thus supported is preferably to extend substantially front-to-back of the vehicle, and substantially the full distance between the front and rear axes.

An electric motor is mounted in the interior compartment. The motor, of course, has a driveshaft. Also on the chassis are means for electrically connecting the battery means (when the battery means are in place) to the motor, so that the battery means power the motor driveshaft.

It is important that, when the battery means are supported in the supporting means, at least major portions of the motor and of the battery means be at approximately the same height as the front and rear rotary driving means. This feature provides much of the favorable weight distribution mentioned earlier, particularly enhancing the operation of the toy vehicle in its climbing-toy mode.

Additionally mounted in the interior compartment is a speed-reduction mechanism connecting the motor driveshaft to both the front- and the rear-rotary driving means mentioned earlier, to transmit rotation from the driveshaft to the rotary driving means with a mechanical advantage. Associated with this speed-reduction mechanism are means for selecting among a plurality of values of the mechanical advantage. These features, speaking broadly to encompass equivalent detailed arrangements for accomplishing the same purposes, may be called means for "establishing and selecting" a mechanical advantage between the motor shaft and the rotary driving means.

Included among the plural values of mechanical advantage is at least one value that provides a combination of relatively high speed and relatively low torque. With this value selected, the vehicle is operable as a generally conventional toy on generally flat surfaces.

Also included is at least one other value that provides a combination of relatively lower speed and relatively higher torque—sufficiently higher that the vehicle is operable as a climbing toy on surfaces that are steeper and/or more irregular. This mode of operation is particularly effective in its cooperation with the treads.

Also included, preferably, is what might be regarded as a "mechanical advantage of zero"—that is to say, a setting of the speed-reduction mechanism in which the motor driveshaft is fully disengaged from the rotary driving means. When such a setting is provided it is particularly advantageous that it be obtained by use of a gear-train configuration in which the rotary driving means rotate freely relative to the gearing (or at least relative to the high-stepdown stages of the gearing), yielding a "rolling neutral."

The toy vehicle should also have electrical contact means for completing an electrical connection between the motor and the battery means, when the battery means are within the housing and the worm gear is engaged. These contact means should also interrupt the electrical connection when the worm gear is not engaged, so that the motor and the high-speed end of the reduction mechanism are disabled when the toy vehicle is shifted into "rolling neutral."

The motor, the speed-reduction mechanism, the selecting means, and the battery means, when the battery means are supported in the supporting means, substantially fully occupy the interior compartment. Thus the entire assemblage is extremely small, providing a truly miniature vehicle whose performance is thereby rendered all the more droll and appealing for toy users.

In a preferred embodiment the speed-reduction mechanism includes a worm that is adapted to be powered by the motor shaft, a worm gear adapted to engage and be driven by the worm, and an axle positioned at the front or rear axis. Tnis entire mechanism is preferably duplicated at the front and rear ends of the chassis; and the front rotary driving means are mounted to the axle that is mounted to the front end of the chassis, and the rear rotary driving means are mounted to the axle that is mounted to the rear end of the chassis.

The front and rear rotary driving means are powered respectively by the worm gears that are mounted to the front and rear ends of the chassis. We prefer to accomplish this powering by driving the axle from the worm gear, and the rotary driving means from the axle, but this geometry is not the only one that is within the scope of certain embodiments of our invention.

We also prefer that the speed-reduction mechanism have a driver gear mounted to or otherwise powered from the motor shaft, and two gear clusters powered by the driver gear. Each of these two gear clusters advantageously consists of a spur-gear section and a worm section, in a one-piece integral assembly. In this document these clusters are called "spur-gear-and-worm clusters." The worm mentioned earlier is provided selectably by the worm section of either one of these two spur-gear-and-worm clusters.

The worm gear in our preferred embodiments is shiftable relative to the spur-gear-and-worm clusters, so that it engages and is driven by the worm section of either of the two clusters. We find it particularly convenient and effective to provide both the shifting of the worm gear and its driving of the axle by giving the worm gear a square-shaped central hole and positioning it to slide along a mating square-cross-section axle, laterally with respect to the chassis, between positions in which the worm gear engages the two worm sections respectively. In this way the worm gear is always in position to drive the axle via their mating square geometries.

In preferred embodiments the worm gear has an intermediate position between those in which it engages the two worms. In this intermediate position the worm gear engages neither worm, thus permitting the worm gear and attached axle and rotary driving means to rotate freely independent of the worms. This feature provides the "rolling neutral" capability already mentioned.

Again, this entire mechanism is duplicated at the two ends of the chassis.

The "establishing and selecting" means mentioned earlier should also include means for actually effectuating the selection. A user should be able to manipulate these effectuating means manually, by simple finger pressure, to operate the vehicle either as a generally conventional toy or as a climbing toy—or in rolling neutral as an unpowered hand toy. We consider it important to make the manually manipulable effectuating means accessible to the user at the side of the toy vehicle housing, while the vehicle rests upon any of its various kinds of operating surfaces, without the necessity for removing the vehicle from such surfaces. We consider it equally important to make the effectuating means operable with the fingers of just one hand.

We have found two embodiments of the mechanism described above to be particularly advantageous, although several others are operable and yield most of the advantages of the preferred embodiments. In both of our preferred embodiments, at each end of the chassis the two spur-gear-and-worm clusters are—as previously noted—powered from a driver gear on the motor shaft.

In one of these embodiments the spur-gear section of a first one of the two clusters is driven by the driver gear directly, and the spur-gear section of the other cluster is driven by the spur-gear section of the first cluster. In this configuration the two clusters consequently rotate in opposite directions, and the two worms are therefore of opposite pitch.

In the other preferred embodiment the spur-gear sections of both of the two clusters are driven by the driver gear directly (as is only one in the first preferred embodiment). In this second preferred embodiment the clusters rotate in the same direction, so the worms have the same "handedness" (rather than opposite as in the first preferred embodiment).

The choice as between these two embodiments or versions is largely a matter of preference, but the two versions do have several advantages in common:

First, we have found that it is desirable to place the gear-train stage at which disengagement is effected (for the purpose of selecting a value of mechanical advantage) "downstream" from the worm. By using this order of elements, we are able to provide the "rolling neutral" capability without any extra point of disengagement and without adding undue complexity to the mechanism.

Second, we have found that it is desirable to place the worm "downstream" in the gear train from any additional reduction stage that is used. By using this order of elements we cause the worm itself to rotate more slowly than the motor driveshaft, and we believe that the efficiency and longevity of the worm are improved by avoiding high-speed rotation of the worm.

Third, we consider it desirable to effect the selection of mechanical-advantage values at a stage in the gear train where the gears are rotating relatively slowly. Doing so minimizes clashing of the gears upon engagement, and gear wear upon both engagement and disengagement, thus extending the life of the mechanism.

The foregoing three advantages are all possessed by the "establishing and selecting" means that have been described above, and whose details are presented later.

Provision of a tread-driven "climbing toy" without the plural modes of operation just discussed is within the scope of certain embodiments of our invention.

All of the foregoing operational principles and advantages of the present invention will be more fully appreciated upon consideration of the following detailed description, with reference to the appended drawings, of which:

BRIEF DESCRIPTION OF THE DRAWINGS

FIG. 5 is an end elevation view, partly in section, of the same embodiment—taken along the line 5—5 of FIG. 4. In this view the worm gear is shown disengaged from both worms.

FIG. 6 is a plan view of the same embodiment, partly in section, taken along the line 6—6 of FIG. 4.

FIGS. 7 and 8 are fragmentary end elevations of a portion of the apparatus as shown in FIG. 5, but with the worm gear engaging the low-speed high-torque worm in FIG. 7, and engaging the high-speed low-torque worm in FIG. 8.

FIG. 9 is an exploded perspective view showing a part of the mechanism for effectuating the selection of mechanical-advantage values, along with the electrical contact means, for the embodiments of FIGS. 1 through 8.

FIG. 10 is a fragmentary elevation, partly in section and taken along the line 10—10 of FIG. 6, showing operating details of some of the FIG. 9 elements as assembled.

FIG. 11 is an end elevation of the exterior of the embodiments of FIGS. 1 through 10, taken from the right foreground as seen in FIG. 1.

FIGS. 12 through 14 show both clusters driven directly from the driver gear.

FIG. 12 is a perspective drawing comparable to FIG. 1 though from a different vantage (namely, the equivalent of the far left foreground in FIG. 1) and showing only the drive details.

FIG. 13 is a fragmentary plan of the FIG. 12 mechanism.

FIG. 14 is a fragmentary side elevation taken along the line 14—14 of FIG. 13.

DETAILED DESCRIPTION OF THE PREFERRED EMBODIMENTS

Figure 1:
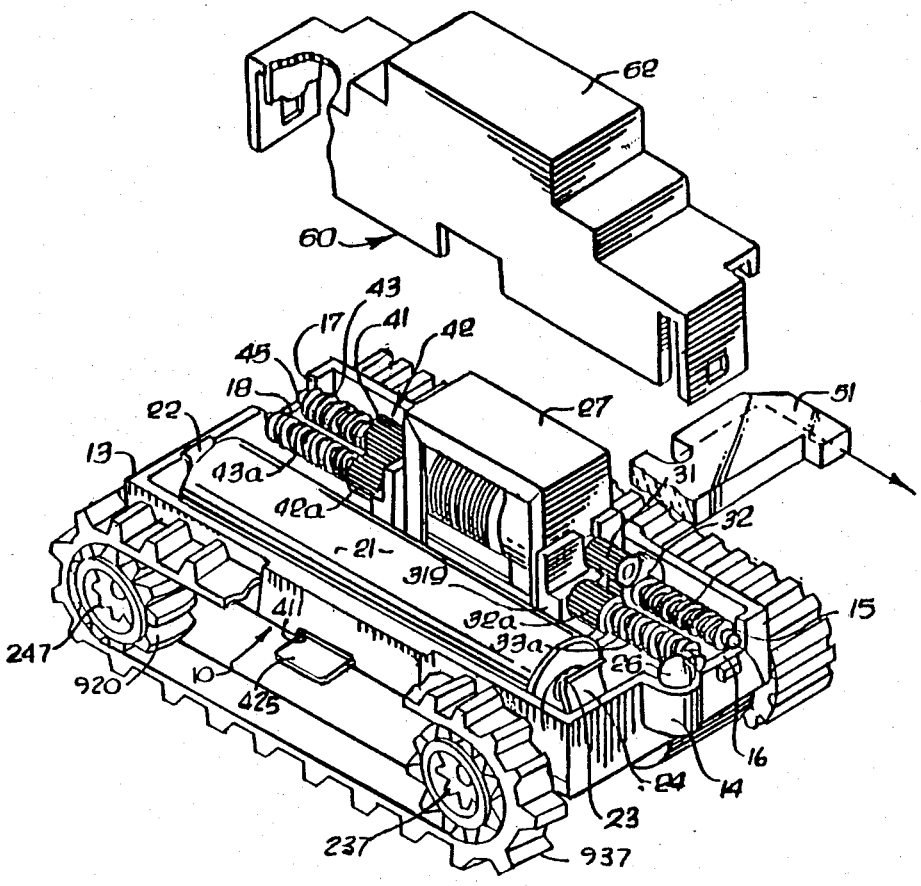
FIG. 1 is a perspective view of a toy vehicle which is a preferred embodiment of our invention, shown without a scale-model vehicle body in place.

As shown in FIGS. 1, 3 through 8, 11 through 14, and 16, preferred embodiments of our invention are built in and around a chassis 10 consisting of upstanding left and right side walls 11, front end wall 12 and rear end wall 13, all erected about the periphery of an extended horizontal floor 19.

The front end wall has a forward protrusion 14 which supports and contains functional connections for a small light bulb 26, and which also supports a transparent light distributor 51. Details of the bulb 26, distributor 51, and related features are presented in the above-mentioned patent and will not be repeated here.

The front end wall 12 also has a generally rectangular slot 15, 16 formed in it. The rear end wall 13 has a similar slot 17, 18. These slots are for use in aligning the mechanism cover 60, which also is discussed in detail in the previously mentioned patent and will not be further discussed here, although some minor differences may arise—principally due to the greater width of the present mechanism. The slots 15, 16, and 17, 18 also function in journaling certain rotating portions of the mechanism. This too is accomplished substantially as described in the previous patent, though the number of rotating parts is larger.

The chassis 10 serves both as a frame to support and as a partial enclosure to conceal and protect the power source and train.

Mounted below the chassis for rolling rotation with respect to it are two mutually parallel but spaced-apart axles, an axle 36 near the front and an axle 46 near the rear of the chassis. Secured to the ends of these two axles 36 and 46 are respective pairs of rotary driving means—front tread drivers 237 and rear tread drivers 247, which are thus in effect mounted to the frame for rolling rotation about respective mutually parallel but spaced-apart axes (the centerlines of the axles 36 and 46), one such axis being in front of the other.

Continuous-belt treads 937 are looped over, suspended between, and preferably driven by both of the drivers.

Mounted atop the chassis floor 19 at a position between the two axles (or tread driver rotation axes) is an electric motor with housing 27. The motor housing 27 is located against one of the side walls 11, and oriented so that its driveshaft 283 (FIGS. 3 and 4) is perpendicular to the two tread-driver-rotation axes. This motor is of a type whose driveshaft extends both fore and aft from the motor housing. The motor housing 27 is secured against longitudinal motion by two blocks 319, which are integral with the chassis floor 19 and the adjacent side wall.

Mounted to the two ends of the motor driveshaft 283 are respective "drive pinions" or "drive gears" (we mean these terms to be interchangeable) 31 at the front and 41 at the rear, which are firmly secured for rotation witn the driveshaft.

Below and to the left (taking the direction of vehicle motion as "straight ahead") of the drive pinions 31 and 41 and meshed with them are respective spur gears 32 and 42, which rotate on corresponding shafts 35 and 45 oriented parallel to the driveshaft. The spur-gear shafts 35 and 45 are each journalled at one of their respective ends into one of the motor blocks 319, and at the other of their respective ends into the corresponding end wall 12 or 13.

Sharing the spur-gear shafts 35 and 45 with the spur gears 32 and 42, and firmly secured to those spur-gear shafts to rotate with them, are respective worms 33 and 43. We prefer to make the spur gears 32 and 42 and the corresponding worms 33 and 43 as respective integral assemblies, or spur-gear-and-worm clusters: one such cluster 32–33 thus has a spur-gear section 32 and worm section 33, and the other cluster 42–43 has a spur-gear section 42 and worm section 43.

Similar spur-gear-and-worm clusters 32*a*–33*a* and 42*a*–43*a* are also provided. These additional clusters are respectively positioned adjacent and parallel to the already discussed spur-gear-and-worm clusters 32–33 and 42–43. Each of the additional clusters 32*a*–33*a* and 42*a*–43*a* is journalled at one of its ends into one of the motor blocks 319, and at the other of its ends into the corresponding end wall 12 or 13.

With the addition of these additional clusters 32*a*–33*a* and 42*a*–43*a*, the fore and aft ends of the drive mechanism remain symmetrical. It may be noted, however, that they are not identical to each other but rather are mirror images: the first-mentioned (high mechanical advantage) clusters 32–33 and 42–43 are "outboard" or toward the left in both ends of the mechanism, while the additional (low mechanical advantage) clusters 32*a*–33*a* and 42*a*–43*a* are "inboard" or toward the right.

The spur-gear sections 32*a* and 42*a* of these additional clusters 32*a*–33*a* and 42*a*–43*a* are driven from the respective adjacent spur-gears 32 and 42 of the outboard clusters 32–33 and 42–43. This drive arrangement causes the inboard clusters 32*a*–33*a* and 42*a*–43*a* to rotate in the opposite direction from the first-mentioned or outboard clusters 32–33 and 42–43.

Accordingly, since the object of the inboard clusters 32*a*–33*a* and 42*a*–43*a* is to drive the respective worm gears 34 and 44 in the same direction though with different mechanical advantages, the worm sections 33*a* and 43*a* are opposite in "handedness"—that is, they are of opposite pitch—relative to the outboard clusters 33 and 43 respectively.

Below these pairs of clusters, and oriented and disposed to mesh with the worm sections 33 and 43, are respective worm gears 34 and 44—each oriented to rotate about axes parallel to the axes of tread driver rotation. The worm gears 34 and 44 and the respective tread driver pairs 237 and 247 are mounted conaxially (that is, together on the same respective axles 36 and 46).

Whereas the tread driver pairs 237 and 247 are fixed to their respective axles 36 and 46, however, the worm gears 34 and 44 are keyed to their respective axles 36 and 46. This may be accomplished, for example, by providing the gears 34 and 44 with respective hubs 434 and 444 (FIGS. 5 and 6) that have square central holes (FIG. 4), and providing the axles 36 and 46 with matching square cross-sections. Thus the worm gears 34 and 44 rotate with, but can slide along, the axles 36 and 46.

The worm gears 34 and 44 in fact can slide along their respective axles 36 and 46 into engagement with either of the respective worms: the front-end worm gear 34 can engage either the worm section 33 of cluster 32–33, or the worm section 33*a* of cluster 32*a*–33*a*; while the rear-end worm gear 44 can engage either the worm section 43 of cluster 42–43, or the worm section 43*a* of cluster 42*a*–43*a*.

The result of sliding the worm gears 34 or 44 between worm sections in this way is to select different values of mechanical advantage between the motor driveshaft 238 and the tread drivers 237 and 247. The difference may be regarded as derived from the additional gear-train stages represented by mutually engaged spur-gear sections 32 and 32*a*, at one end of the chassis, and mutually engaged spur-gear sections 42 and 42*a* at the other end of the chassis.

Thus each of the worm gears 34 and 44 drives a respective pair 237 or 247 of tread drivers, but with mechanical-advantage values that depend upon the positions along the axles 36 and 46 of the worm gears 34 and 44, relative to the worm sections 33 and 33*a* at the front of the chassis, and 43 and 43*a* at the rear.

FIGS. 6 and 9 show a detent mechanism consisting of an arm 491 extending from the shifting element 425–425*a*, and dimensioned to be "springy" in the direction fore and aft of the vehicle, and a triple-notched structure 492 formed in the housing floor 19 and positioned to engage the arm 491. This mechanism is dimensioned and located to provide three stable positions for the shifting element 425–425*a*, in which positions, respectively, the worm gears are (1) engaged with the low-mechanical-advantage worms, or (2) engaged with the high-mechanical-advantage worms, or (3) disengaged entirely. It is to be understood that the three positions in our preferred embodiment do not exist in the order just stated, the disengaged position being the middle one; and that it is within the scope of our invention to provide the three positions in *any* order.

The tread drivers 237 and 247, as well as the axles 36 and 46 themselves, must rotate relative to the housing walls 11—even though the axles 36 and 46 are square. If desired, the tread drivers 237 and 247 may be provided with externally cylindrical but internally square bushings, fitted snugly over the square ends of the axles 36 and 46, but rotating smoothly in cylindrical holes formed in downward extensions of the chassis walls 11 (see FIGS. 5 through 8). We have found, however, that such bushings need not be provided, and an economy can therefore be realized, if the axles 36 and 46 and the housing walls 11 are made of suitable materials and suitably configured. In particular, we have found that with drawn steel axles—having smooth, rounded corners —and with housing walls 11 made of hard plastic such as the materials known commercially as ABS or "Delrin," there is insignificant wear of the housing walls, the loads involved being quite light.

In this way the tread drivers may be driven by a symmetrical power train having only two or three stages and yet providing a choice between very high mechanical advantage and only moderate mechanical advantage, between the motor driveshaft and the axles. This versatile power train occupies a narrow space along one side of the chassis 11—and thus leaves the greater width of the chassis for a "penlight" battery 21 (whose positive pole appears at 23) and the appropriate electrical connectors 22 and 24.

As to the battery polarity, the motor connections, and the "handedness" or pitch direction of the worms used in our invention, it is to be understood that any *two* of these factors may be reversed and the toy vehicle will operate in the same direction. For instance, if the battery polarity is reversed and the handedness of the worms is also reversed, the vehicle will still move "forward" as defined by the front/rear terminology used in this document.

From the fact that the dry-cell battery 21 appearing in FIG. 1 is only a size-AA penlight type, the remarkably small overall size of the vehicle may be seen dramatically. Yet, due to the simplicity of the novel drive train, it is possible to obtain the two modes of operation described earlier, and without highly miniaturized or high-precision gears.

The point at which shifting and disengagement is effected in the described mechanism—that is, the functional location of the shiftable and disengageable worm gears 34 and 44—is "downstream" in the power train from the worms 33, 33*a* and 43, 43*a* respectively. Hence the mechanism has the added advantage, noted earlier, of providing a freely operable "rolling neutral."

The worms 33, 33*a* and 43, 43*a* are respectively "downstream" in the power train from additional gear-reduction stages composed of the drive pinions or spur gears 31 and 41 in combination with the spur-gear sections 32, 32*a* and 42, 42*a* of the spur-gear-and-worm clusters. Hence the mechanism has the further advantage, also noted earlier, of operating the worms 33, 33*a* and 43, 43*a* at relatively low speeds for better operating efficiency.

The disengageable and shiftable worm gears 34 and 44, moreover, are at the final, lowest-rotational-velocity point in the power train. Hence the mechanism has the yet further advantage of "shifting" the lowest-speed gears available, and thereby minimizing clash and wear.

Figure 12:
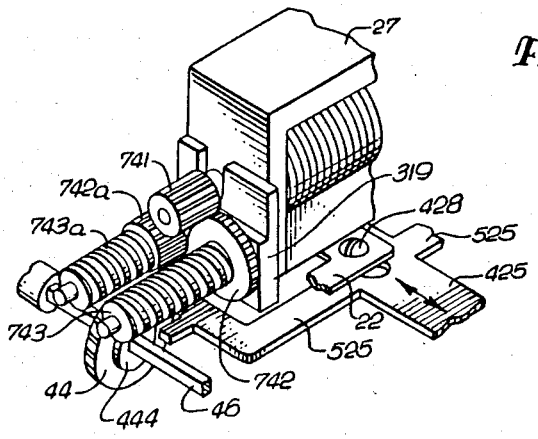
FIGS. 12 through 14 show an alternative preferred embodiment to the detailed drive mechanism of FIGS. 1, 3, 4, 5, 7 and 8. In particular, whereas the latter six drawings depict a first spur-gear-and-worm cluster driven directly from a driver gear on the motor shaft, and the other spur-gear-and-worm cluster driven from the spur-gear section of that first cluster.
Figure 13:
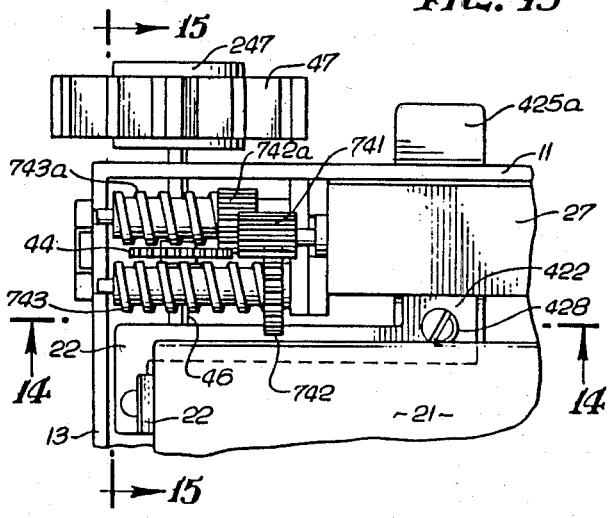
Figure 15:
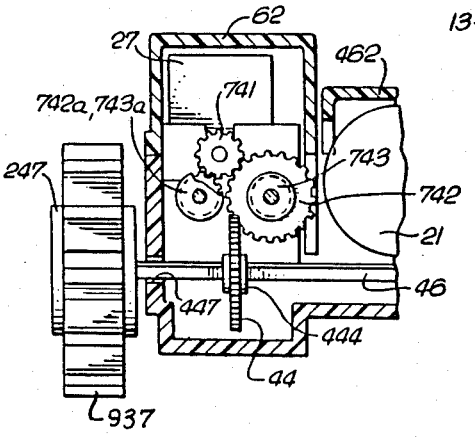
FIG. 15 is a fragmentary end elevation taken along the line 15—15 of FIG. 13.
Figure 14:
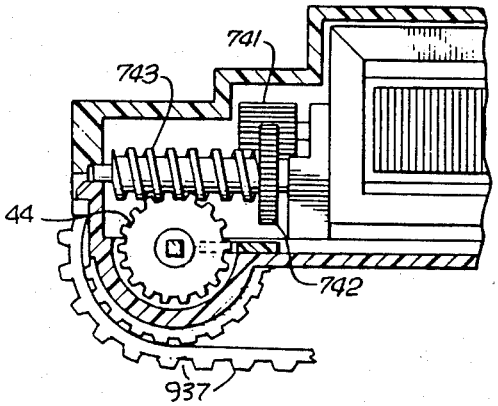

FIGS. 12 through 14 illustrate another embodiment of the power-train features of our invention. This embodiment too has all of the foregoing advantages. Subject to slight reservations it may be regarded as a variant that is equally preferred with the embodiment already discussed. These drawings are representative of both ends of the mechanism, though with a mirror-image form of duplication as encountered in the previously discussed embodiment.

Here the pinion or driver gear 741 is lengthened so that it can engage continuously both (1) the spur-gear section 742 of the low-speed spur-gear-and-worm cluster 742–743 and (2) the spur-gear section 742*a* of the high-speed spur-gear-and-worm cluster 742*a*–743*a*. Both clusters are thus driven in common directly from the driver 741, whereas in the previously described embodiment the corresponding high-speed cluster 42*a*–43*a* was driven from the spur section 42 of the low-speed cluster 42–43 as an intermediate.

Examination of the drawings will reveal that the resulting speeds of the respective high-speed clusters 42*a*–43*a* and 742*a*–743*a* (i.e., their angular velocities) are identical. They are identical because the intermediate spur 42 transmits the pinion rotation "1:1"—that is, without any gearing change—to the high-speed cluster.

Since the intermediate spur 42 introduces a reversal of rotational sense, however, the directions of high-speed cluster rotation are opposite for the two configurations. In the embodiment of FIGS. 12 through 15 the worms 743*a* and 743 consequently rotate in the same direction, rather than in opposite directions as do the worms 43 and 43*a* of the first-discussed embodiment. The handedness or pitch of the two worms 743*a* and 743, therefore, is the same rather than opposite.

The various other elements of the variant embodiment in FIGS. 12 through 15 are essentially the same as those in the drawings relating to the first-discussed embodiment. Accordingly the detailed discussion of these other features is not repeated here.

Some preference for the first-discussed embodiment may arise from the slight protrusion of the low-speed spur section 742, in the variant embodiment, toward the battery compartment; however, this may well be overcome by minor rearrangements of the parts.

A miniature scale-model vehicle body (such as 74 in FIG. 2) is fitted to the chassis 10. The body 74 snaps on and off to permit easy changing of the battery 21, as generally described in the previously mentioned patent. The body style may be designed from "fantasy," or may be derived from a real vehicle body, with some adjustment of proportions to fit the chassis.

Figure 2:
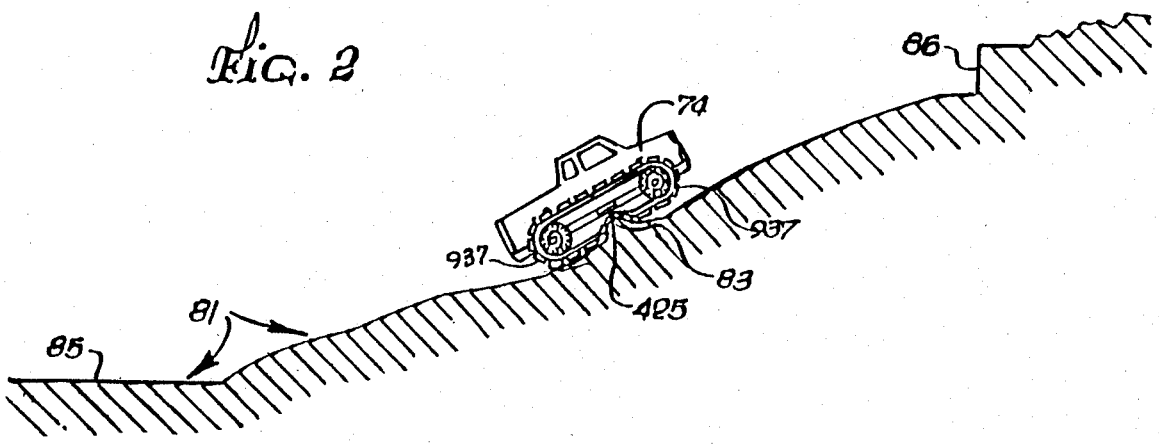
FIG. 2 is a generalized elevation of the embodiment of FIG. 1 in use on an accompanying toy terrain, particularly illustrating the dual (climbing and conventional) capabilities of the toy and also illustrating the appearance of the toy with a scale-model vehicle body in place.
Figure 3:
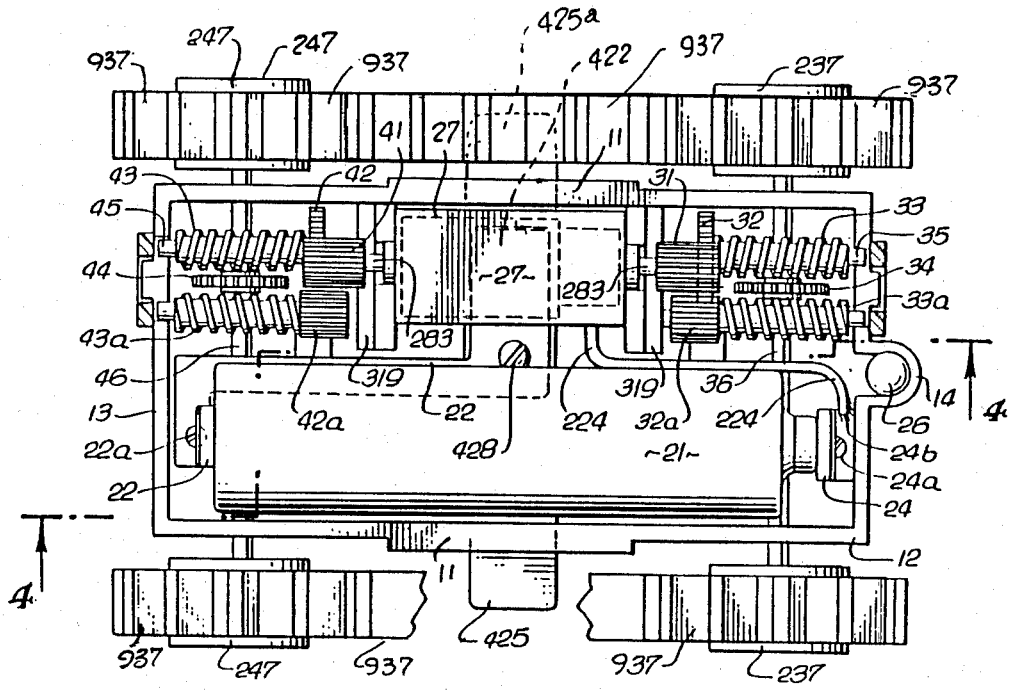
FIG. 3 is a plan view of the embodiment of FIGS. 1 and 2, shown without the mechanism cover that appears in FIG. 1.
Figure 4:
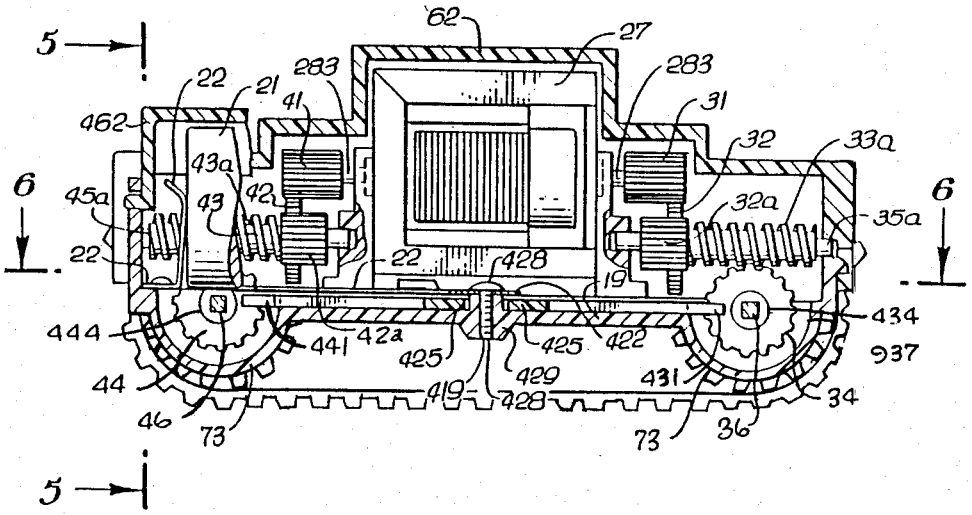
FIG. 4 is a side elevation view, partly in section, of the embodiment of FIGS. 1 through 3, taken along the line 4—4 of FIG. 3.

The toy vehicle of the previously mentioned patent was uniquely adapted for operation on steep surfaces such as portion 83 of the toy terrain shown in FIG. 2, and over vertical steps taller than its own tread driver radius, such as that at 86 in FIG. 2, and on surfaces that are irregular, or both steep and irregular. The toy vehicle of our present invention is also operable on all such surfaces, by virtue of its plural selectable mechanical-advantage values. The toy vehicle of our present invention, however, is also operable in a satisfying mode of play on generally flat and regular surfaces such as portion 85 of the terrain in FIG. 2.

To obtain excellent traction, the treads 937 can be provided with extremely exaggerated cleats.

Some details of the construction of this preferred embodiment of our invention include protective worm-gear wells, such as the rear well 73, encasing the worm gears 34 and 44 respectively, and drive-mechanism cover 60. The wells such as rear well 73 must be wider than the corresponding structures appropriate to the invention of the earlier-mentioned patent, because the wells in the present case must accommodate the lateral motion of the worm gears 34 and 44 along their axles.

The journalling of the spur-gear-and-worm clusters into the chassis, at the ends of the clusters that are remote from the motor housing, may be accomplished as indicated in the previously mentioned patent, or in other convenient ways.

The electrical switching mechanism of our present invention is in part novel. Battery 21 applies power through contacts 22 and 24 (FIGS. 3, 6, 9, and 10) to the light bulb 26 and motor 27 in parallel. The rear-end metal contact 22 is fixed to the housing floor 19 by means of a self-tapping screw 22*a*. This contact 22 is extended along the side of the battery to metallic contact 422, which contacts the bottom of the motor housing 27 to complete the circuit, but only (as will be described in detail) when the worm gear is engaged with one of the worms.

The other metal contact 24 is similarly secured to the housing floor by a similar screw 24*a*; soldered at 24*b* to this contact 24 is the bared conductive end of an insulated length of wire 224, whose remote end engages an appropriate contact point on the motor.

The novel aspect of this mechanism resides in the use of a single manual control to effectuate (1) selection of mechanical advantage, or (2) disengagement of the tread drivers from the gearing entirely, and (3) completion or interruption of the electrical connections, depending upon whether the control is in position to select a nonzero value of mechanical advantage in accordance with choice number (1), or in position to disengage the tread drivers in accordance with choice number (2).

As can be seen from FIGS. 9 and 10, the contact strip 22, 422 is pinned to the chassis floor 19 by means of another self-tapping screw 428, which is threaded into a hole 419 formed in the floor 19. The floor 19 is thickened at this point, to provide sufficient thread length for secure attachment of the screw 428, by formation of a boss 429—which extends both downward and upward relative to the nearby portions of the floor 19.

The upper extension of the boss 429 also forms a standoff and guide pin. The boss functions as a standoff in that it holds the contact strip 422 up away from the floor 19 proper. In the space thus formed between the strip 422 and the floor 19 fits the shifting element 425, 425*a*. This shifting element defines a slot 526, which is dimensioned to accept the guide-pin/standoff/boss 429. The shifting element is retained between the floor 19 and the contact 422. As shown, the shifting element 425, 425*a* is made slightly thinner than the height of the upward extension of the boss 429, so that the shifting element can slide smoothly between the floor 19 and the contact 422.

The shifting element extends and slides through apertures 411 (FIG. 1) in both side walls 11, and has manually manipulable ends 425 and 425*a* that are—when the shifting element is installed in the chassis 10—thus user-accessible near the bottom of the outside of the chassis 10, at the left and right sides of the toy vehicle respectively. The shifting element also has shifting forks 534 and 544 (FIGS. 6 and 9) that are sized and disposed to engage the worm gears 34 and 44 respectively, to drive the worm gears laterally (along their respective square axles) into engagement with the respective worms 33, 33*a* and 43, 43*a*—or into an entirely disengaged intermediate position, for "rolling neutral," for the objectives previously indicated.

The "dogleg" structure 525 of the shifting element is an advantageous arrangement for obtaining access to the worm gears 34 and 44, to shift them, while clearing the bottom ends of the motor mounts 319.

The effectuating means mentioned earlier include all the provisions described in the foregoing three paragraphs. The overall result of these combined provisions is that a user may shift between the three modes of operation of the toy vehicle without picking the vehicle up, and using just one hand to move the shift element leftward or rightward between the stable positions of the detent mechanism.

In particular, to shift the element from its leftward or central position toward the right, the user can:

(1) place her or his left thumb (or right index finger, if it is preferred to use the right hand) against the right side of the vehicle body, above or next to the shift element end 425 but not obstructing the shift element end 425;

(2) place the left index finger (or right thumb, if the right hand is to be used) against the left end 425*a* of the shift element; and (3) squeeze the thumb and index finger together to complete the shifting.

Similarly, to shift the element from its rightward or central position toward the left, the user can place the left index finger (or right thumb) against the left side of the vehicle body, but positioned to avoid obstructing the shift element end 425*a*, and the left thumb (or right index finger) against the right end 425 of the shift element, and squeeze to complete the shifting.

It is also possible to operate the shifting mechanism by holding the vehicle down with the palm of the hand or with one or more fingers, while pushing the shifting element laterally with one finger. We do not prefer this way of using the mechanism, because it does not yield the same degree of control as the way described in the preceding paragraphs, but it is within the scope of our invention.

These ways of using the shifting element thus provides relative motion between that element and the other parts of the shifting mechanism, to actually effectuate the selection of mechanical advantage—or, in other words, to actually effectuate the selection among plural operating modes. The word "manipulable" and the phrase "manipulable . . . with one hand only" are used in the appended claims to describe the suitability of the shifting element for use in this way—that is, not merely that the shifting element can be manipulated, but that when it is manipulated it is *effective;* it can be manipulated in with only one hand to obtain the relative motion required for selection of a mechanical advantage or operating mode.

A dimple 523 (FIGS. 6, 9, and 10) formed in the top surface of the shifting element 425, 425*a* accommodates a mating dimple 423 formed in the contact element 22, 422, when the two are in alignment, permitting the motor-contact end 422 of the contact element to descend out of contact with the bottom of the motor housing 27. This is the condition of the shifting and contact elements when the shifting element is in position to *dis*engage the worm gears 34 and 44 from both of their respective mating worms, as previously described.

When the shifting element is in position to engage the worm gears 34 and 44 with either of their respective mating worms, however, the dimple 523 in the top surface of the shifting element 425, 425*a* is moved out of alignment with the dimple 423 in the contact element 22, 422, forcing the upturned end 422 of the contact element upward into contact with the bottom of the motor housing 27.

Figure 16:
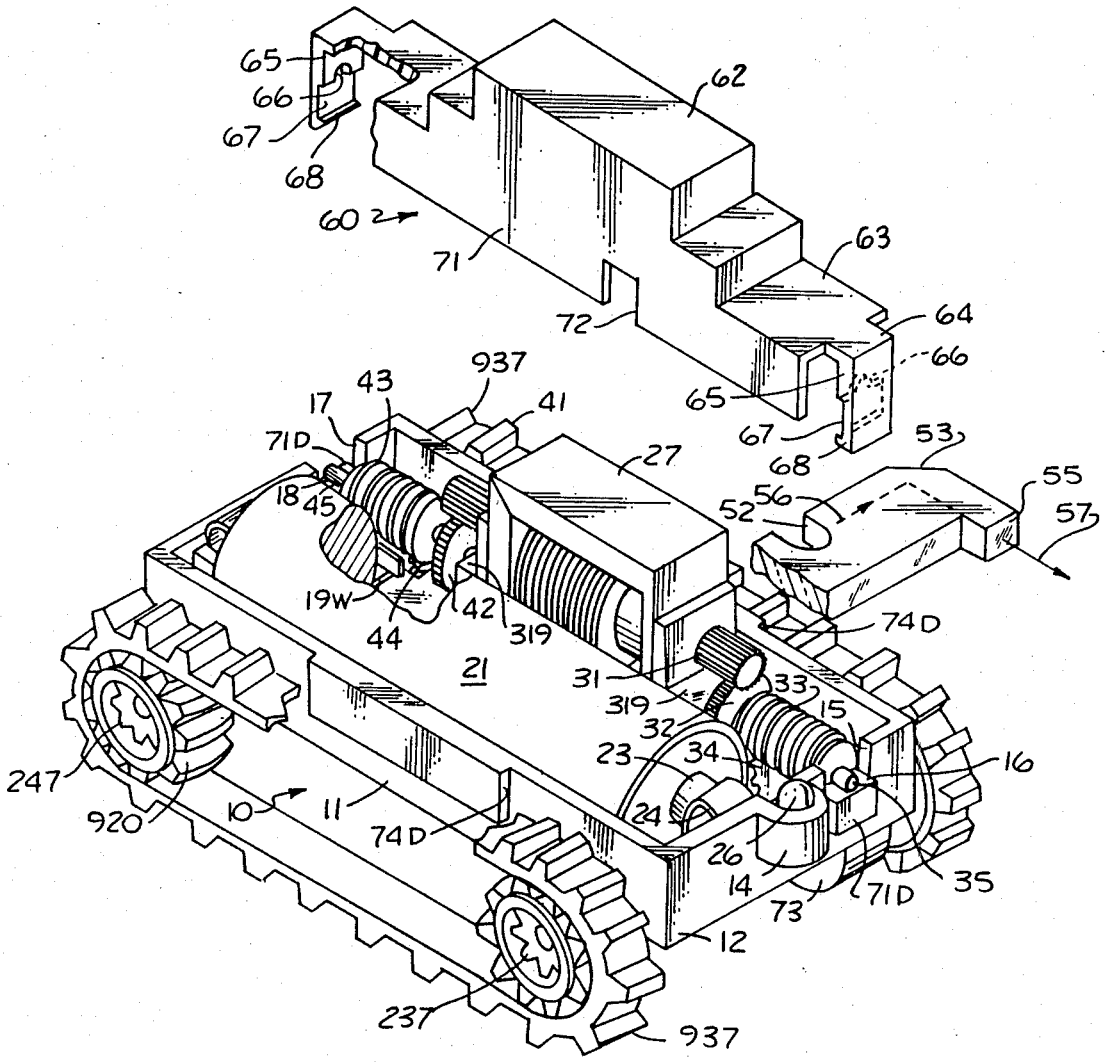
FIG. 16 is a perspective view, comparable to FIG. 1, of a toy vehicle which is another preferred embodiment of our invention.

As shown in FIG. 16, tread drive may be provided in combination with a single-operating-mode, single-speed "climbing toy" that is otherwise as shown in FIG. 1 (and described in the corresponding text) of the above-mentioned patent. In this embodiment, the features and advantages are those resulting from enhancement of the extraordinary "climbing-toy" features by the extremely exaggerated traction of the treads.

These features and advantages are especially salient when the vehicle climbs over objects which a wheeled vehicle could simply straddle, fore to aft, and on which it would therefore "hang up."

These features in combination produce a "climbing-toy" operation which is unique by virtue of its extreme exaggeration.

It is to be understood that all of the foregoing detailed descriptions are by way of example only, and not to be taken as limiting the scope of our invention—which is expressed only in the appended claims.

We claim:

1. A plural-speed miniature treaded toy vehicle for use with electrical battery means that comprise a dry-cell battery, and for both generally conventional-toy operation at at least one speed on a generally flat surface and climbing-toy operation at at least one reduced speed with greater torque on a steep and/or irregular surface; said vehicle having, when such battery means are in use therewith, major weight components positioned to provide a generally symmetrical, compact, balanced and relatively low arrangement that enhances such climbing-toy operation; said vehicle comprising:

a chassis that has a front end and a rear end;

rotary driving means mounted to the chassis for rolling rotation about at least one laterally extending front axis and at least one laterally extending rear axis;

endless-belt tread means supported from and driven by the rotary driving means, and disposed to engage such surfaces to propel the vehicle relative such surfaces;

means mounted to the chassis to releasably support such electrical battery means;

an electric motor mounted to the chassis, and having a driveshaft;

means on the chassis for electrically connecting such battery means, when supported in the supporting means, to the motor, so that such battery means power the motor driveshaft;

a speed-reduction mechanism mounted to the chassis and connecting the motor driveshaft to said wheel means to transmit rotation from the driveshaft to the rotary driving means with a mechanical advantage, said speed-reduction mechanism comprising, rotatably mounted to each of said front and rear ends of the chassis, a worm adapted to be powered by the motor shaft, a worm gear adapted to engage and be driven by the worm, and an axle positioned at a corresponding one of the front and rear axes; and means associated with the speed-reduction mechanism for selecting among a plurality of values of the mechanical advantage, including at least one value providing such generally conventional-toy operation for generally flat surfaces and at least one other value providing such climbing-toy operation with greater torque for steep and/or irregular surfaces;

the rotary driving means comprising front rotary driving means mounted to the axle that is mounted to the front end of the chassis, and rear rotary driving means mounted to the axle that is mounted to the rear end of the chassis;

the front and rear rotary driving means being adapted to be powered respectively by the worm gears that are mounted to the front and rear ends of the chassis; and the tread means comprising an endless-belt tread that is looped over, suspended between, and driven by both of the front and rear rotary driving means;

at least major portions of the motor and of such battery means, when such battery means are supported in the supporting means, being at approximately the same height as the rotary driving means, to particularly enhance such climbing-toy operation at said other value on such steep and/or irregular surfaces; and the speed-reduction mechanism comprises, rotatably mounted to the housing at each of said front and rear ends, a driver gear adapted and disposed to be powered from the motor shaft, and two spur-gear-and-worm clusters adapted and disposed to be powered by the driver gear, the said worm that is adapted to be powered by the motor shaft being provided selectably by either one of the two spur-gear-and-worm clusters;

the worm gear is shiftable relative to the spur-gear-and-worm clusters, to engage and be driven by either of the two spur-gear-and-worm clusters;

the axle is adapted and disposed to be driven by the worm gear; and the rotary driving means are adapted and disposed to be driven by the axle.

2. The toy vehicle of claim 1, wherein:

each of the two spur-gear-and-worm clusters comprises a spur-gear section and a worm section;

the spur-gear section of a first one of the two spur-gear-and-worm clusters is adapted and disposed to be driven by the driver gear; and the spur-gear section of the other one of the two spur-gear-and-worm clusters is adapted and disposed to be driven by the spur-gear section of the first spur-gear-and-worm cluster.

3. The toy vehicle of claim 2, wherein the respective worm sections are of opposite pitch.

4. The toy vehicle of claim 1, wherein:

each of the two spur-gear-and-worm clusters comprises a spur-gear section and a worm section;

the spur-gear section of each of the two spur-gear-and-worm clusters is adapted and disposed to be driven directly by the driver gear.

5. The toy vehicle of claim 4, wherein the respective worm sections are not of opposite pitch.

6. The toy vehicle of claim 1, wherein:

said establishing and selecting means comprise manually manipulable means for effectuating the said selecting among plural values; whereby such user by manipulating the effectuating means may operate the vehicle either as a generally conventional toy or as a climbing toy;

the said effectuating means are accessible to such user at the side of the toy vehicle housing while the vehicle rests upon such surfaces, and are manipulable by finger pressure applied in that area;

whereby such user by applying such finger pressure without removing the vehicle from such surfaces may operate the vehicle either as a generally conventional toy or as a climbing toy, in which latter instance the tread means and greater torque cooperate to provide particularly enhanced climbing-toy operation for extremely steep and/or irregular surfaces.

7. The toy vehicle of claim 2, wherein:

said establishing and selecting means comprise manually manipulable means for effectuating the said selecting among plural values; whereby such user by manipulating the effectuating means may operate the vehicle either as a generally conventional toy or as a climbing toy;

the said effectuating means are accessible to such user at the side of the toy vehicle housing while the vehicle rests upon such surfaces, and are manipulable by finger pressure applied in that area;

whereby such user by applying such finger pressure without removing the vehicle from such surfaces may operate the vehicle either as a generally conventional toy or as a climbing toy, in which latter instance the tread means and greater torque cooperate to provide particularly enhanced climbing-toy operation for extremely steep and/or irregular surfaces.

8. The toy vehicle of claim 1, wherein:

said establishing and selecting means comprise manually manipulable means for effectuating the said selecting among plural values; whereby such user by manipulating the effectuating means may operate the vehicle either as a generally conventional toy or as a climbing toy;

the said effectuating means are accessible to such user at the side of the toy vehicle housing while the vehicle rests upon such surfaces, and are manipulable by finger pressure applied in that area;

the establishing and selecting means are also operable for disengaging the worm gear entirely from both spur-gear-and-worm clusters, thereby disengaging the rotary driving means from the motor shaft to place the toy vehicle in "rolling neutral"; and the effectuating means are manipulable to effectuate such disengaging, alternative to effectuating such selecting of mechanical advantage; whereby such user by applying such finger pressure without removing the vehicle from such surfaces may:

(1) place the toy vehicle in "rolling neutral"; or (2) operate the vehicle as a generally conventional toy on generally flat surfaces; or (3) operate the vehicle as a climbing toy on relatively steep and irregular surfaces, in which case the tread means and greater torque cooperate to provide particularly enhanced climbing-toy operation for extremely steep and/or irregular surfaces.

9. The toy vehicle of claim 2, wherein:

said establishing and selecting means comprise manually manipulable means for effectuating the said selecting among plural values; whereby such user by manipulating the effectuating means may operate the vehicle either as a generally conventional toy or as a climbing toy;

the said effectuating means are accessible to such user at the side of the toy vehicle housing while the vehicle rests upon such surfaces, and are manipulable by finger pressure applied in that area;

the establishing and selecting means are also operable for disengaging the worm gear entirely from both spur-gear-and-worm clusters, thereby disengaging the rotary driving means from the motor shaft to place the toy vehicle in "rolling neutral"; and the effectuating means are manipulable to effectuate such disengaging, alternative to effectuating such selecting of mechanical advantage; whereby such user by applying such finger pressure without removing the vehicle from such surfaces may:

(1) place the toy vehicle in "rolling neutral"; or (2) operate the vehicle as a generally conventional toy on generally flat surfaces; or (3) operate the vehicle as a climbing toy on relatively steep and irregular surfaces, in which case the tread means and greater torque cooperate to provide particularly enhanced climbing-toy operation for extremely steep and/or irregular surfaces.

10. The toy vehicle of claim 8, also comprising electrical contact means for:

completing an electrical connection between the motor and such battery, when such battery is received by the housing and the worm gear is engaged with either of the two spur-gear-and-worm clusters; and interrupting the electrical connection when the worm gear is not engaged with either spur-gear-and-worm cluster;

said completing and interrupting means being actuated by the effectuating means, whereby such user by applying such finger pressure without removing the vehicle from such surfaces may:

(1) operate the toy as an unpowered rolling toy vehicle; or (2) operate the toy vehicle as a generally conventional toy on generally flat surfaces; or (3) operate the toy vehicle as a climbing vehicle on relatively steep and irregular surfaces, in which case the tread means and greater torque cooperate to provide particularly enhanced climbing-toy operation for extremely steep and/or irregular surfaces.

11. The toy vehicle of claim 9, also comprising electrical contact means for:

completing an electrical connection between the motor and such battery, when such battery is received by the housing and the worm gear is engaged with either of the two spur-gear-and-worm clusters; and interrupting the electrical connection when the worm gear is not engaged with either spur-gear-and-worm cluster;

said completing and interrupting means being actuated by the effectuating means, whereby such user by applying such finger pressure without removing the vehicle from such surfaces may:

(1) operate the toy as an unpowered rolling toy vehicle; or (2) operate the toy vehicle as a generally conventional toy on generally flat surfaces; or (3) operate the toy vehicle as a climbing vehicle on relatively steep and irregular surfaces, in which case the tread means and greater torque cooperate to provide particularly enhanced climbing-toy operation for extremely steep and/or irregular surfaces.

12. A miniature electrically self-powered treaded toy vehicle capable of climbing over rough terrain and obstacles as well as up steep inclines, said vehicle having major weight components positioned to provide a generally symmetrical, compact, balanced, and relatively low arrangement, while also providing adequate ground clearance in the area between the front and rear tread drivers, said vehicle comprising:

a frame having a pair of opposed sides;

front rotary driving means and rear rotary driving means mounted to the frame for rolling rotation about respectively mutually parallel but spaced-apart front and rear axes, the distance between the front and rear axes being generally about two inches;

endless-belt tread means looped over, suspended between, and driven by both of the front and rear rotary driving means;

an electric motor mounted adjacent to one of said sides of the frame, and having a driveshaft which is perpendicular to the two axes and extends both fore and aft from the motor;

means mounted to the frame to releasably support electrical battery means, the battery means comprising an elongated dry-cell battery, said battery being located adjacent the other of said sides of the frame in a position with its longitudinal axis substantially parallel to the driveshaft and extending substantially the full distance between said front and rear axes, the motor and battery substantially occupying the full width between said opposed sides of the frame, said motor being positioned between said axes and being substantially shorter than the distance between said axes to provide a pair of transmission spaces, one fore and one aft of the motor;

means for electrically connecting such battery means, when the battery means are supported in the supporting means, to the motor, so that the battery means power the motor; and a pair of transmission means, each at least partially disposed in one of said transmission spaces and each comprising a speed reduction mechanism connecting one end of the driveshaft to one of the rotary driving means to transmit rotation from the driveshaft to such rotary driving means with reduced speed and with increased power;

at least a major portion of said battery, motor and transmission means being at approximately the same height as said front and rear rotary driving means, said frame, motor, battery and transmission means not protruding any appreciable distance below the level of said front and rear axes in the area between said front and rear rotary driving means.

13. The toy vehicle of claim 12 wherein, transverse to the driveshaft, said motor is generally rectangular, having a shorter dimension and a longer dimension, said motor being positioned with said shorter dimension extending between said battery means and the frame side.

14. The toy vehicle of claim 12 wherein said motor is generally equally distant between said front and rear axes.

15. The toy vehicle of claim 12 wherein each of said transmission means comprises a worm driven by the motor, and a worm gear that is driven by the worm and that drives a rotary driving means.

16. The toy vehicle of claim 12 said tread means having such flexibility and length as to significantly preserve such ground clearance when the vehicle climbs over objects that can fit between the front and rear rotary driving means.

* * * * *